US006082217A

United States Patent [19]

Wheeler

[11] Patent Number: 6,082,217

[45] Date of Patent: Jul. 4, 2000

[54] BRAKE TRANSMISSION SHIFT INTERLOCK ASSEMBLY

[75] Inventor: Douglas J. Wheeler, Farmington Hills, Mich.

[73] Assignee: Teleflex Incorporated, Plymouth Meeting, Pa.

[21] Appl. No.: 09/132,250

[22] Filed: Aug. 11, 1998

[51] Int. Cl.[7] ..... G05G 11/00

[52] U.S. Cl. ..... 74/483 R; 192/220.4; 192/220.7

[58] Field of Search ..... 74/483 R; 477/96; 192/220.3, 220.4, 220.5, 220.6, 220.7

[56] References Cited

U.S. PATENT DOCUMENTS

| | | | |
|---|---|---|---|
| 4,880,092 | 11/1989 | Kito et al. . | |
| 4,884,668 | 12/1989 | Kobayashi et al. . | |
| 4,905,802 | 3/1990 | Gotoh | 74/483 R X |
| 4,909,096 | 3/1990 | Kobayashi . | |
| 4,932,493 | 6/1990 | Sakurai et al. . | |
| 4,942,937 | 7/1990 | Amberger et al. | 192/220.3 X |
| 5,016,738 | 3/1991 | Shirahama et al. . | |
| 5,029,680 | 7/1991 | Kobayashi et al. . | |
| 5,176,231 | 1/1993 | Moody et al. . | |
| 5,187,999 | 2/1993 | Kobayashi et al . . | |
| 5,220,984 | 6/1993 | Ruiter | 192/220.4 |
| 5,337,030 | 8/1994 | Mohler . | |
| 5,421,792 | 6/1995 | Kataumi et al. . | |
| 5,431,266 | 7/1995 | Ito et al. . | |
| 5,431,267 | 7/1995 | Togano et al. . | |
| 5,489,246 | 2/1996 | Moody et al. . | |
| 5,490,585 | 2/1996 | Togano . | |
| 5,493,932 | 2/1996 | Plocher | 74/483 R |
| 5,566,587 | 10/1996 | Sogo et al. . | |
| 5,582,073 | 12/1996 | Takeuchi et al. . | |
| 5,588,330 | 12/1996 | Kataumi et al. . | |
| 5,647,465 | 7/1997 | Burkhard et al. . | |
| 5,677,658 | 10/1997 | Osborn et al. . | |

*Primary Examiner*—David A. Bucci
*Assistant Examiner*—Brandon C. Stallman
*Attorney, Agent, or Firm*—Howard & Howard

[57] ABSTRACT

A transmission selector mechanism (16) in a vehicle (10) having a transmission (20), a braking system (14), and a gear selector mechanism (22) is used to prevent the transmission selector mechanism (16) from moving out of a Park position (24) unless a brake pedal (18) has been depressed. A brake pedal (18) remotely controls the braking system (14) and is moveable between a rest position and an applied position. The gear selector mechanism (22) is moveable between a Park position (24) and a plurality of drive positions (26) for remotely controlling the transmission (20). The gear selector mechanism (22) includes an axially movable rod (42) having a bottom end (60) and a detent (62) extending laterally from the rod (42) for disposition in any one of the Park (24) and drive (26) positions. An interlock system (70) initially restrains the detent (62) in the Park position (24) until the brake pedal (18) is moved to the applied position. The interlock system (70) includes an actuator (74) disposed axially under the rod (42) for selectively allowing the detent (62) out of the Park position (24). The actuator (74) is rotatable between an engaged position and a disengaged position. When the brake pedal (18) is moved to the applied position the actuator (74) is rotated to the engaged position such that the bottom end (60) of the rod (42) can be axially depressed into engagement with the actuator (74) allowing the detent (62) to be moved out of the park position (24) and into one of the plurality of drive positions (26).

28 Claims, 5 Drawing Sheets

BRAKE TRANSMISSION SHIFT INTERLOCK ASSEMBLY

TECHNICAL FIELD

In a vehicle, an interlock assembly between the gear selector mechanism of an automatic transmission and the brake pedal restrains the gear selector mechanism in the Park position until the brake pedal is first depressed.

BACKGROUND OF THE INVENTION

Vehicles have a transmission assembly having a plurality of gears corresponding to different drive speeds and directions. Typically transmissions have a Reverse gear, a Neutral position, a Park position, and a plurality of drive gears. A gear selector mechanism is controlled by a vehicle operator for selectively moving between these various transmission gears and positions. Sometimes, a vehicle may unexpectedly move when the gear selector mechanism is moved into one of the drive or reverse gears if the vehicle's engine is running. This movement is much more likely to occur if the vehicle operator has not depressed the brake pedal. Also, the vehicle may unexpectedly move when the gear selector mechanism is moved into one of the gears if the vehicle operator has mistakenly place their foot on the vehicle's accelerator pedal instead of the brake pedal. Both of these situations are undesirable because as the vehicle unexpectedly moves, it may bump or hit an object causing damage to the vehicle and/or the object.

Interlock assemblies are usually used to prevent a gear selector lever from being moved out of a Park position unless the brake pedal is sufficiently depressed so that the vehicle brakes will prevent the vehicle from moving. These interlock assemblies can be purely mechanical, purely electrical, or a hybrid combination of mechanical and electrical systems. This prior art assemblies are often complex, expensive, and are comprised of a high number of parts, which requires more packaging room and increases assembly time and cost. Thus, it is desirable to have an inexpensive interlock system that simplifies assembly time and cost by reducing the number of parts and improves packaging.

SUMMARY OF THE INVENTION AND ADVANTAGES

A transmission selector mechanism includes a gear selector mechanism that is moveable between a Park position and a plurality of drive positions. The mechanism has an axially movable rod with a bottom end and a detent extending laterally from the rod for disposition in any one of the Park and drive positions. The transmission selector mechanism also includes an interlock system with an actuator for initially restraining the detent in the Park position.

The improvement allows the interlock system to be packaged in a very compact unit area. Therefore, the available mounting and positioning opportunities for the interlock system are increased. Also, the compact interlock system arrangement permits other adjacent components to be more freely located in the increased available packaging space. Further, a significant cost savings is realized because the transmission selector mechanism has been simplified with the overall number of required parts being reduced resulting in a reduction in assembly time.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
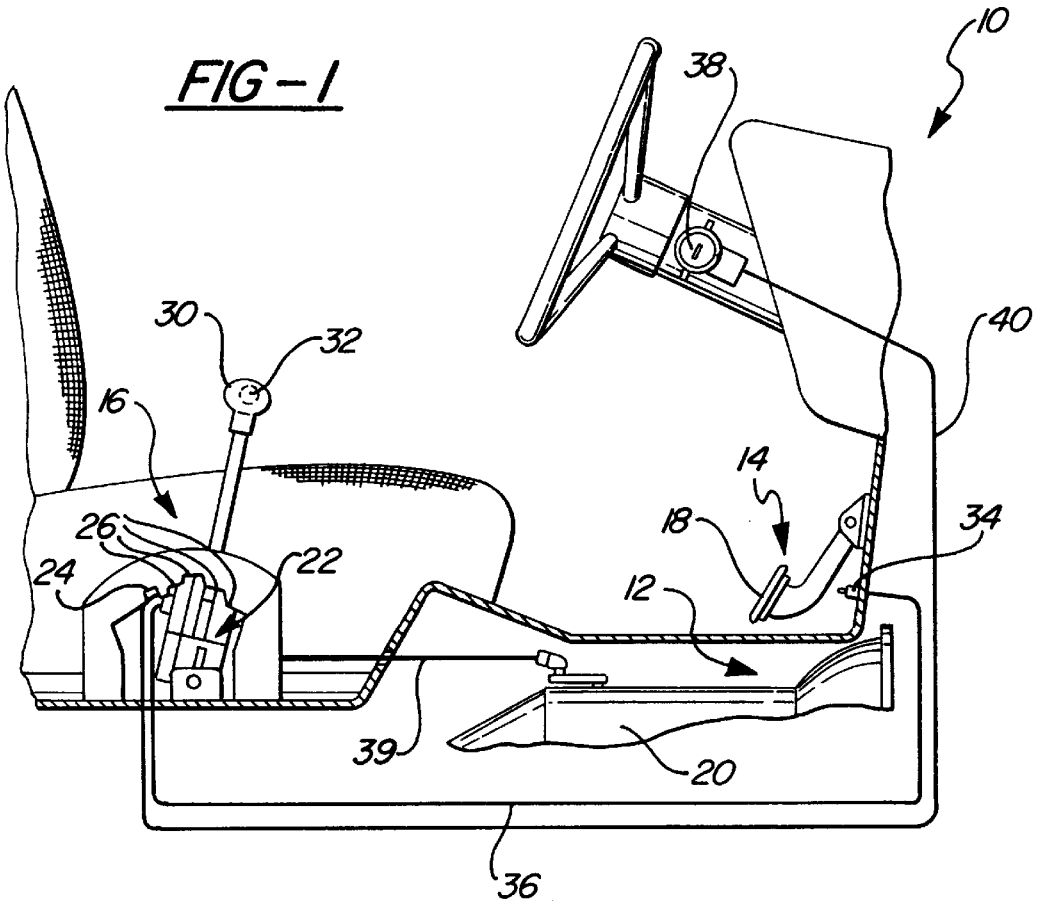
FIG. 1 is a schematic view of a vehicle incorporating the subject transmission selector mechanism.

Referring to the Figures, wherein like numerals indicate like or corresponding parts throughout the several views, a vehicle 10 including a transmission assembly 12, a brake system 14, and a transmission selector mechanism 16 is shown in FIG. 1. The transmission assembly 12 includes a transmission 20 with a plurality of gears (not shown) for providing variable speed and directions for the vehicle 10 based on engine input torque and speed.

The brake system 14 is remotely controlled by a brake pedal 18 which is actuated by a vehicle operator. The brake pedal 18 is moveable between a rest position and an applied position. In the applied position, the brake pedal 18 is depressed by the vehicle operator for controlling the braking system 14 to prevent the vehicle 10 from moving. In the rest position, the brake pedal 18 is returned to its initial position before it was depressed by the vehicle operator. A locator 34 is used to determine whether or not the brake pedal 18 has been depressed. The locator 34 can be any of various sensors known in the art and can be mechanical or electrical. For example, the locator 34 could be a switch that is activated by engagement with the pedal 18 when the pedal 18 is in the applied position. A signal 36 is sent to either an electronic control unit (ECU) or to the gear selector mechanism 16 indicating that the brake pedal 18 is in the applied position.

The transmission selector mechanism 16 includes a gear selector mechanism 22 that is moveable between a Park position 24 and a plurality of drive positions 26, including a reverse position. The gear selector mechanism 22 includes a rod 42, shown in FIG. 2, supported in a lever housing 28 and axially moveable between a depressed position and a retracted position. A knob 30 with a control button 32 is supported with respect to one end of the rod 42 such that actuation of the button 32 causes the rod 42 to move axially with respect to the lever housing 28.

Actuation of the rod 42 controls the positioning of the gear selector mechanism 16 in the Park 24 and drive 26 positions. An interlock system 70, shown in FIG. 3 and discussed in more detail below, prevents the gear selector mechanism 22 from moving out of the Park position 24 until the brake pedal 18 is depressed.

Once the brake pedal 18 is placed in the applied position, the control button 32 is depressed, which actuates the rod 42, which allows the gear selector mechanism 22 to be moved out of the Park position 24 and into one of the drive positions 26. Once the gear selector mechanism 22 is moved out of the Park position, an electrical signal 39 corresponding to the selected drive position 26 is preferably sent to the ECU to indicate which gear the transmission 20 should be shifted into. While an electrical signal 39 is preferred, the subject invention could also have a mechanical connection between the gear selector mechanism 22 and the transmission 20.

A park lock function can also be incorporated into the subject invention. A vehicle ignition 38 is moveable between awn ON position and an OFF position. In the ON position, a vehicle key (not shown) is inserted into the ignition 38 and rotated causing a vehicle starter to start an engine. In the OFF position the key is rotated back to its initial position and removed. In a vehicle 10 with a park lock feature, the key cannot be removed from the ignition 38 unless the vehicle 10 is in the Park position 24. When the vehicle 10 is in Park 24, an electrical signal 40 is preferably sent to the ECU or to the ignition 38 indicating that the vehicle 10 is in Park 24 and that the key can be removed. While an electrical signal 40 is preferred, the subject invention could also have a mechanical connection between the gear selector mechanism 22 and the ignition 38. Also, the subject invention does not require the park lock function, however, it is an additional feature that can be easily incorporated into the subject invention, thus eliminating the need for a separate park lock system.

Figure 2:
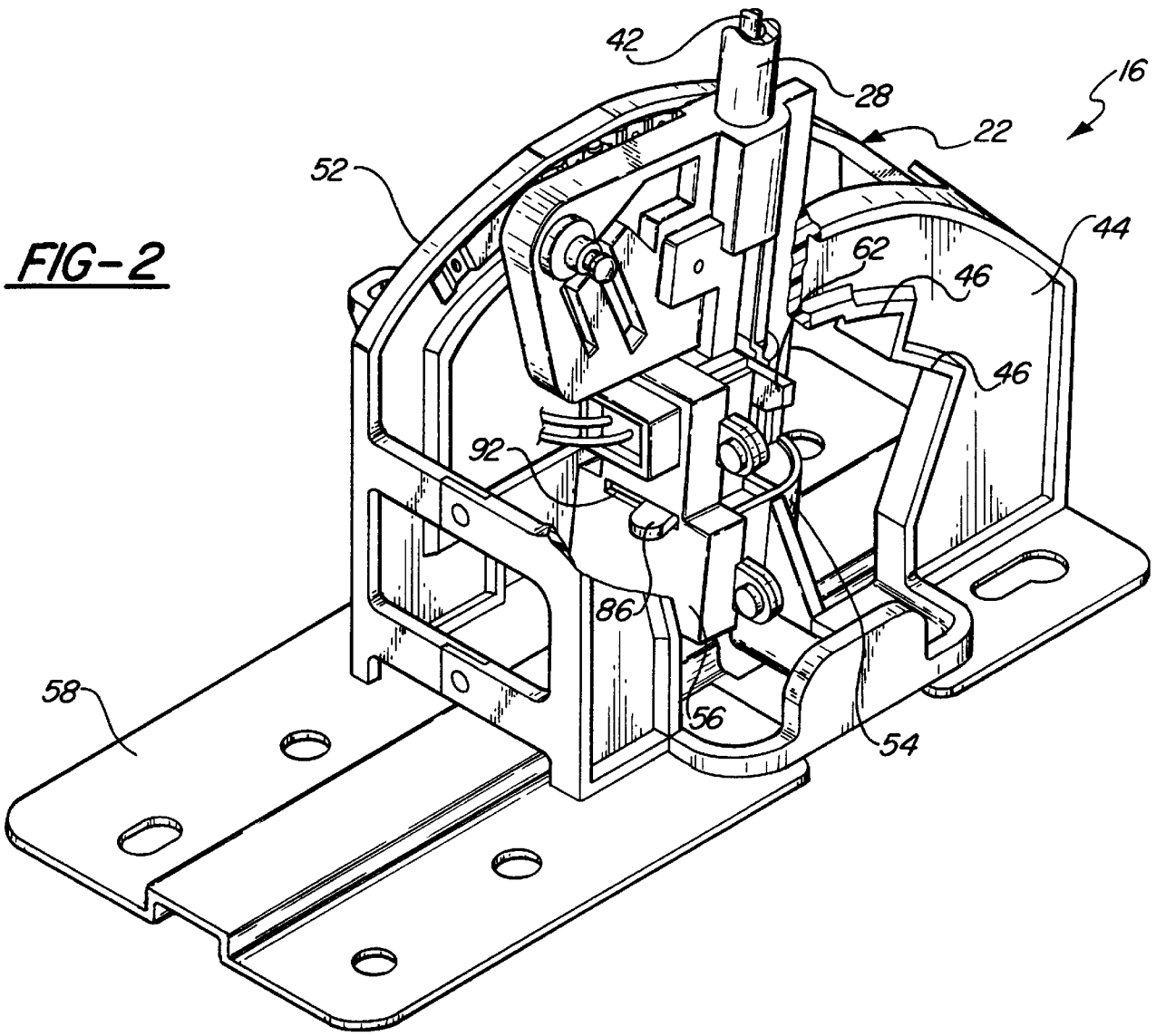
FIG. 2 is a fragmentary perspective view of the subject transmission selector mechanism shown assembled.

As shown in FIG. 2, the transmission selector mechanism 16 includes a park gate 44 having a plurality of notches 46 (only two are shown) corresponding in number to the Park 24 and plurality of drive 26 positions for the gear selector mechanism 22. The transmission selector mechanism 16 also preferably includes an indicator housing 48 for supporting an indicator mechanism 50, shown in FIG. 3, used in conjunction with a detent plate 52 to indicate to the vehicle operator what gear the transmission 20 is in and to provide a shift effort/feel for the operator. This is discussed in greater detail below.

A gear selector housing is preferably comprised of two (2) pieces, a main support housing 54 and a cover 56. The gear selector housing is preferably made from plastic, however, other materials can be used to form the housing. The cover 56 is attached to the main support housing 54 by any of various means well known in the art including but not limited to screws, bolts, rivets, gluing, welding, snap-fits, or heat staking. The gear selector mechanism 22, the gear selector housing, the detent plate 52, and the park gate 44 are preferably mounted to the vehicle 10 with a base bracket 58.

Figure 3:
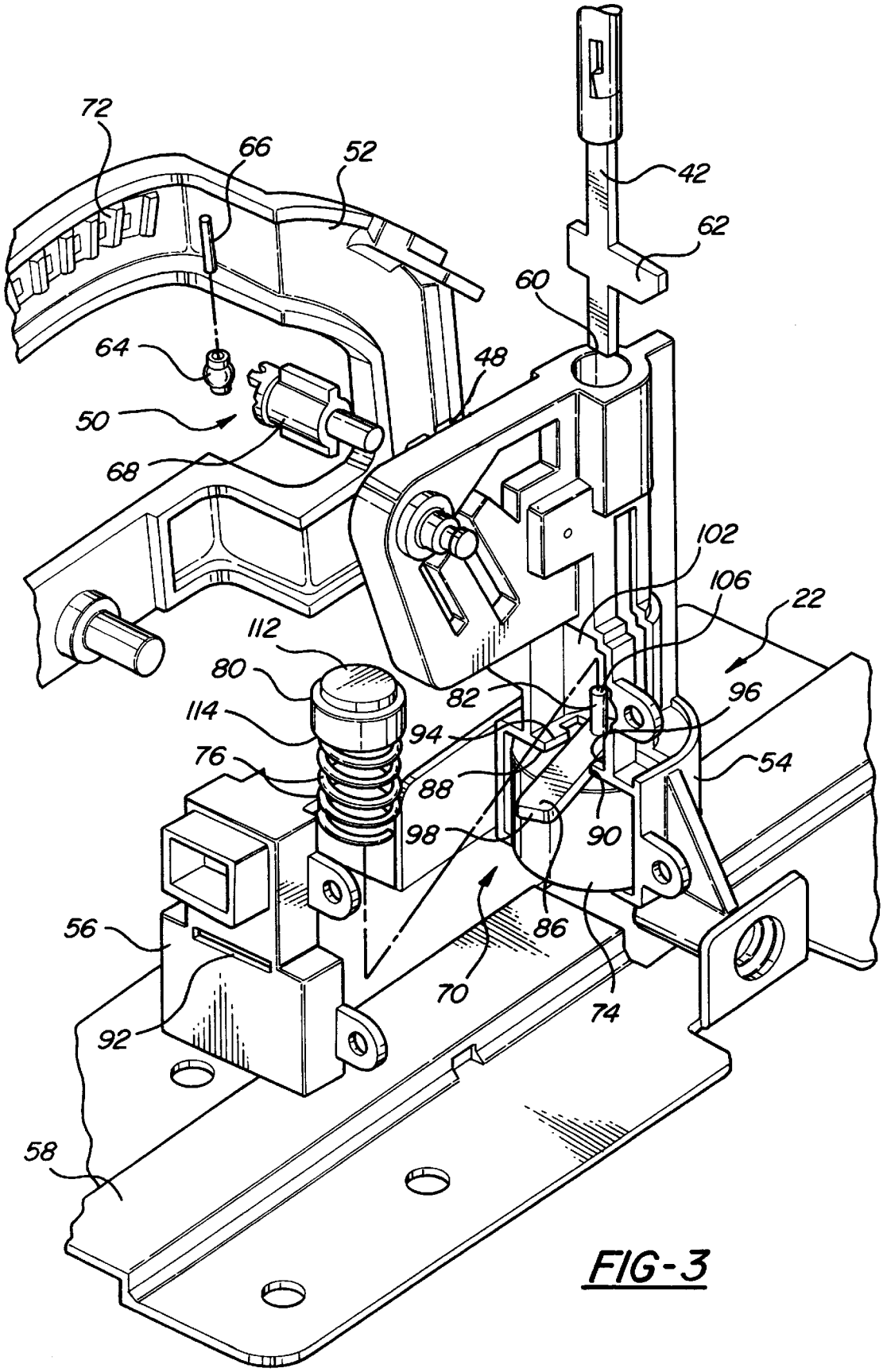
FIG. 3 is a fragmentaary exploded perspective view of the transmission selector mechanism shown in FIG. 2.

The rod 42 has a bottom end 60, shown in FIG. 3 and a pawl or detent 62 extending laterally from the rod 42 for disposition in any one of the Park and drive positions. The detent 62 is used in conjunction with the slots 46 in the park gate 44. Unless the brake pedal 18 is in the applied position, the detent 62 is located in the slot 46 corresponding to the Park position 24 and cannot be moved to any other slots 46.

An exploded view of the transmission selector mechanism 16 is shown in FIG. 3. The indicator mechanism 50 preferably includes a detent roller 64, a roller shaft 66, and a roller holder 68. The roller holder 68 is supported in the indicator housing 48, which moves with rod 42. The detent roller 64 is rotatably supported on the roller shaft 66 which is attached to the roller holder 68. As the gear selector mechanism 22 is moved between the Park 24 and drive 26 positions, the roller holder 68 moves the detent roller 64 along a detent formation 72 on detent plate 52. The detent formation 72 is preferably comprised of a plurality of rounded valleys separated by a rounded peaks. There is one valley for each of the Park 24 and drive 26 positions. While the indicator mechanism 50 preferably is a detent roller style mechanism, other indicating mechanisms for providing shift feel and for indicating to the driver which gear the transmission 20 is in, that are well known in the art could also be used.

The interlock system 70 for initially restraining the detent 62 in the Park position 24 includes an actuator 74 disposed axially under the rod 42 for selectively allowing the detent 62 out of the Park position 24. The actuator 74 is centrally located under the rod 42 and is rotatable between an engaged position and a disengaged position. In the engaged position the actuator 74 rotates such that the bottom end 60 of the rod 42 can be depressed into engagement with the actuator 74 causing the detent 62 to move out of the Park position 24 and into one of the plurality of drive positions 26. In the disengaged position, the actuator 74 is rotated to a position where the rod 42 cannot be depressed into engagement with the actuator 74 and the detent 62 is prevented from moving out of the Park position 24.

The actuator 74 is preferably a brushless torque actuator, similar to the type shown in U.S. Pat. No. 5,337,030 and assigned to Lucas Industries, Inc. While a brushless torque actuator is preferred, other rotary actuators well known in the art could be used, such as a rotary solenoid or an ultrasonic motor, for example.

Figure 5:
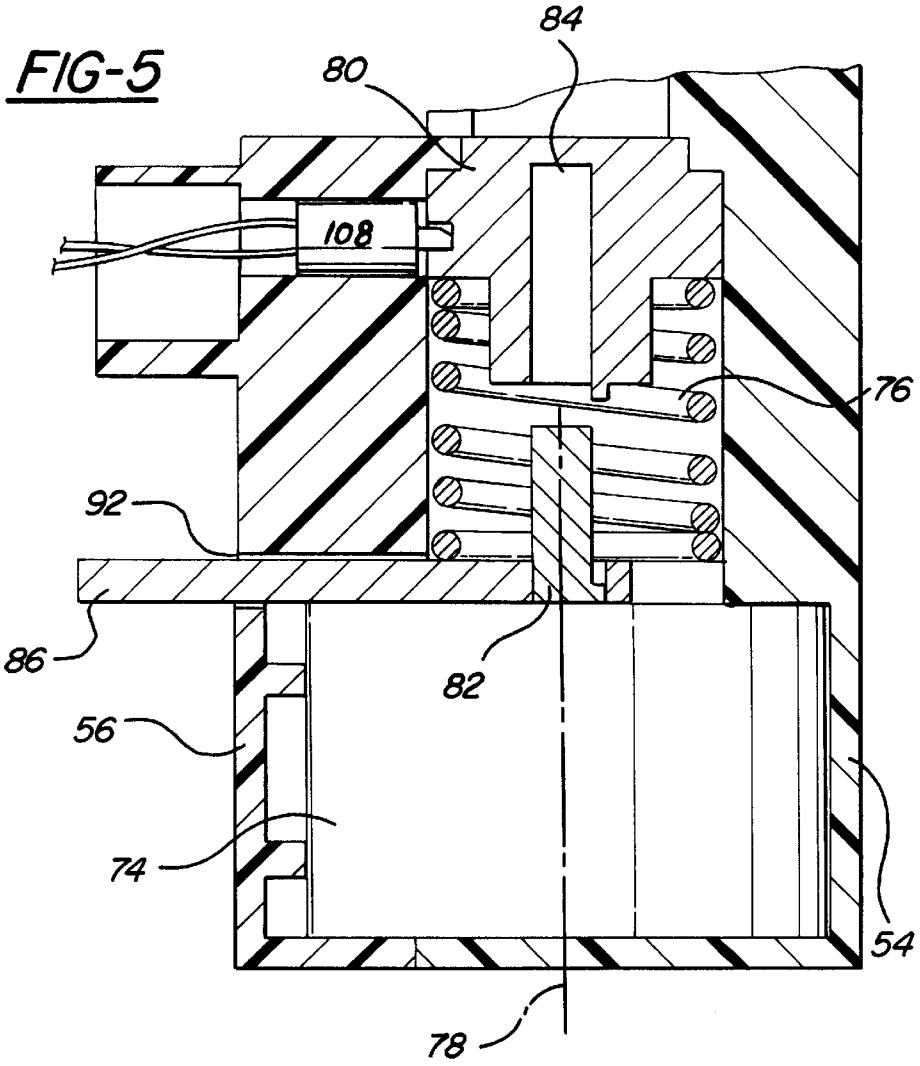
FIG. 5 is an enlarged view, partially cut away, of the cross section shown in FIG. 4.

The interlock system 70 includes a biasing member 76 that acts axially upon the rod 42 for urging the detent 62 into the Park 24 and drive 26 positions. The actuator 74 is also preferably centrally located under the rod 42 and defines an axis of rotation 78, shown in FIG. 5, about which the actuator 74 rotates between the engaged and disengaged positions. The biasing member 76 is preferably concentric with the axis of rotation 78 and is preferably comprised of a coil spring with a cap 80 supported by the spring. The cap 80 reacts against the bottom end 60 of the rod 42. While the cap 80 is shown as a separate member in the interlock system 70 it should be understood that the cap 80 could be integrally formed onto the bottom end 60 of the rod 42 such that the bottom end 60 of the rod 42 would be directly engaging the actuator 74.

The actuator 74 includes an abutment 106 moveable between an abutting position engaging the bottom end 60 of the rod 42 to prevent movement of the detent 62 out of the Park position 24 and a release position for allowing the rod 42 to move the detent 62 out of the Park position 24. The actuator 74 rotates the abutment 106 into and out of the abutting position. In the abutting position, the abutment 106 is not properly aligned with the rod 42, i.e., the rod 42 cannot be moved into the depressed position to allow the detent 62 to move out of the Park position 24. In the release position, the abutment 106 is properly aligned with the rod 42, i.e., the rod 42 can be moved into the depressed position, allowing the detent 62 to move into one of the drive positions 26.

Figure 6:
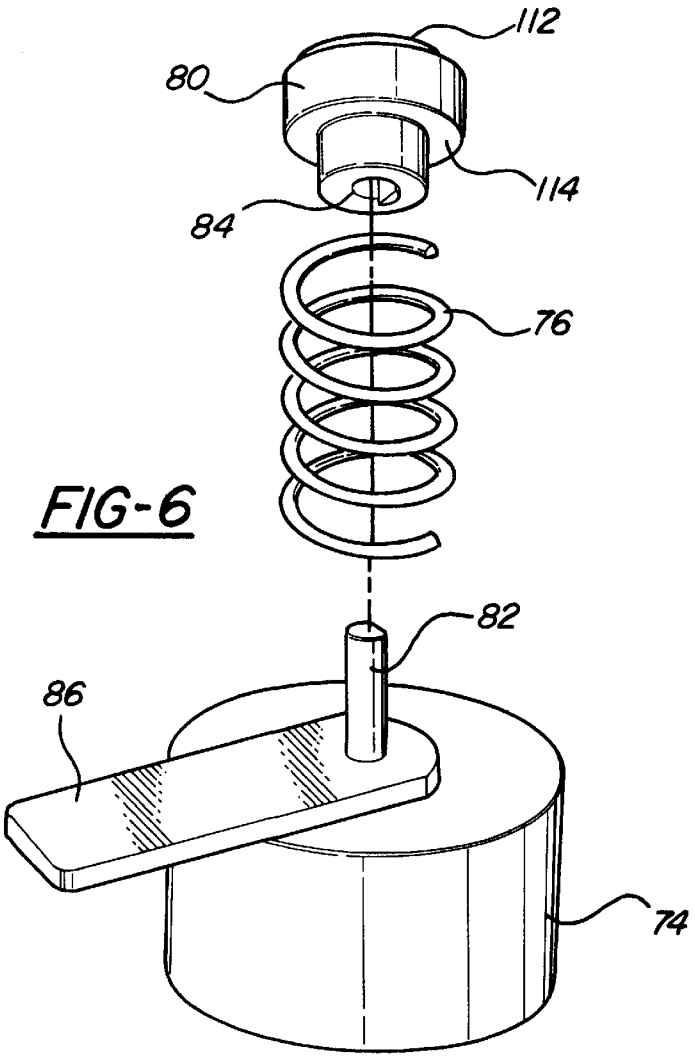
FIG. 6 is a perspective view of the actuator and cap assembly.

As shown in FIG. 6, the abutment 106 is preferably comprised of an output shaft 82 having an irregular cross section. The cap 80 includes a female pocket 84 complimentary in cross sectional shape to the shaft 82 for allowing the shaft 82 to move into the pocket 84 when in the release position. The irregular cross section is preferably a "D" shape, shown in FIG. 6, however, other shapes could be used. As previously mentioned, the cap 80 could be integral with the rod 42 such that the bottom end 60 of the rod 42 would have the female pocket 84 for engaging the shaft 82. Thus, when the brake pedal 18 is depressed the actuator 74 is caused to rotate to the engaged position where the shaft 82 becomes aligned with the pocket 84 allowing the shaft 82 to be received in the pocket 84 as the rod 42 is depressed. This results in the detent 62 moving out of the Park position 24 and into one of the drive positions 26.

Figure 7:
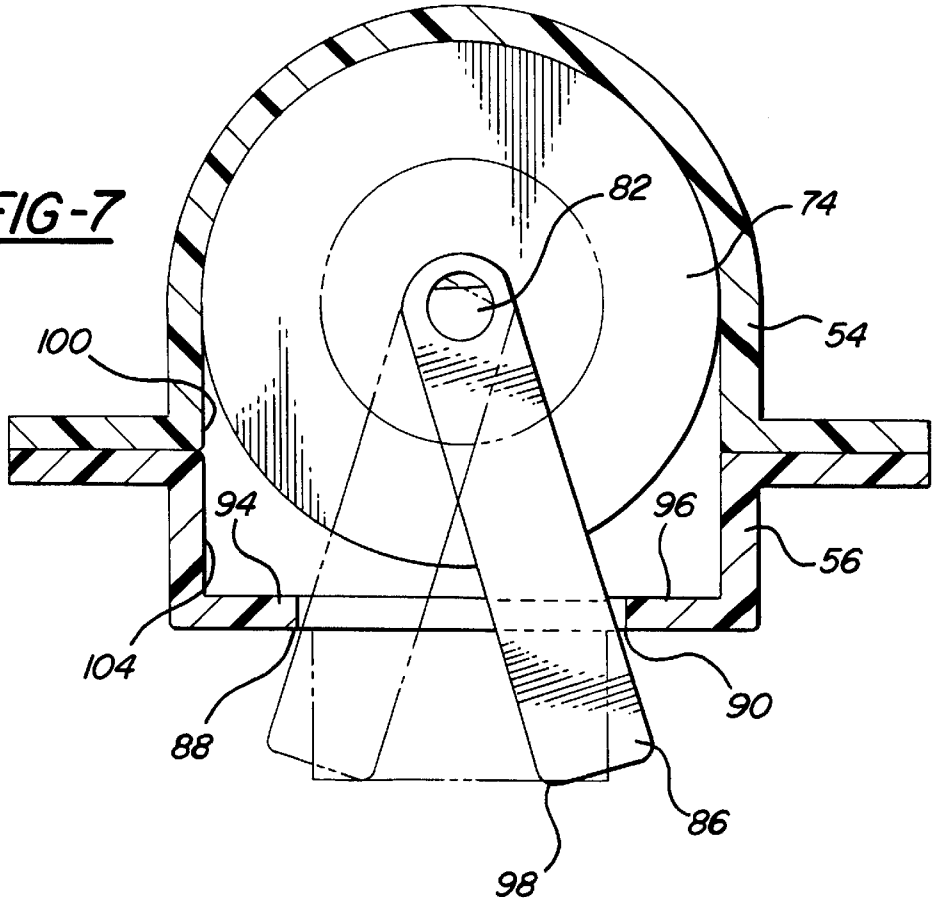
FIG. 7 is a top view, partially in cross section, of the actuator and positioning lever showing the first and second stops.

The interlock system 70 also includes a positioning lever 86 fixed for rotation with the actuator 74 and moveable between a first stop 88 and a second stop 90, shown more clearly in FIG. 7. The first stop 88 corresponds to the disengaged position and the second stop 90 corresponds to the engaged position. The gear selector housing supports the actuator 74 and the rod 42 and defines an opening 92 for receiving the positioning lever 86. The opening 92 has first 94 and second 96 side walls. The first stop 88 occurs when the positioning lever 86 engages the first side wall 94 and the second stop 90 occurs when the positioning lever 86 engages the second side wall 96, shown by the dashed lines in FIG. 7. Thus, the stops 88, 90 are use to properly position the shaft 82 with respect to the pocket 84. Using the stops 88, 90 is a simple way to properly align the actuator and does not require monitoring of the rotational position of the actuator 74. Using the stops 88, 90 also eliminates noise typically associated with a rotary brushless torque actuator, as discussed in detail below.

The positioning lever 86 is preferably made from plastic as is the gear selector housing, i.e. the main support housing 54 and the cover 56. This provides a positive plastic to plastic stop engagement. The plastic positioning lever 86 engages the plastic sidewalls 94, 96 as the lever 86 moves from the first stop 88 to the second stop 90. This plastic to plastic engagement significantly reduces stop position noise that usually accompanies brushless torque actuators. Using the stop positions 88, 90 that are external to the actuator 74 to control rotational position of the actuator 74 also simplifies the alignment process for the shaft 82 and pocket 84.

The positioning lever 86 extends radially from the actuator 74 and is preferably fixed to and rotates with the output shaft 82, however, the positioning lever 86 could also be formed as part of the actuator body 74. One end 98 of the positioning lever 86 partially extends through the opening 92 such that the lever 86 can be manually shifted between the first 88 and second 90 stops. Thus, the positioning lever 86 also serves as a manual release for rotating the abutment 106 between the abutting and release positions. This feature is useful for shifting the gear selector mechanism 22 out of Park 24 when the vehicle cannot provide power to the actuator 74. The actuator 74 also includes an internal spring mechanism (not shown) to return the actuator 74 to a consistent rotational position when power is not supplied to the actuator 74.

As previously mentioned, the gear selector housing has a main support member 54 and a cover 56 for attachment to the main support member 54. The main support member 54 has a first pocket 100 for partially receiving the actuator 74 and a second pocket 102 for receiving the bottom end 60 of the rod 42. The cover 56 has a cover pocket 104 for partially receiving the actuator 74 and which includes the opening 92 for receiving the positioning lever 86. The actuator 74 is preferably cylindrical in shape and thus the pockets 100 and 104 preferably include curved surfaces.

Figure 4:
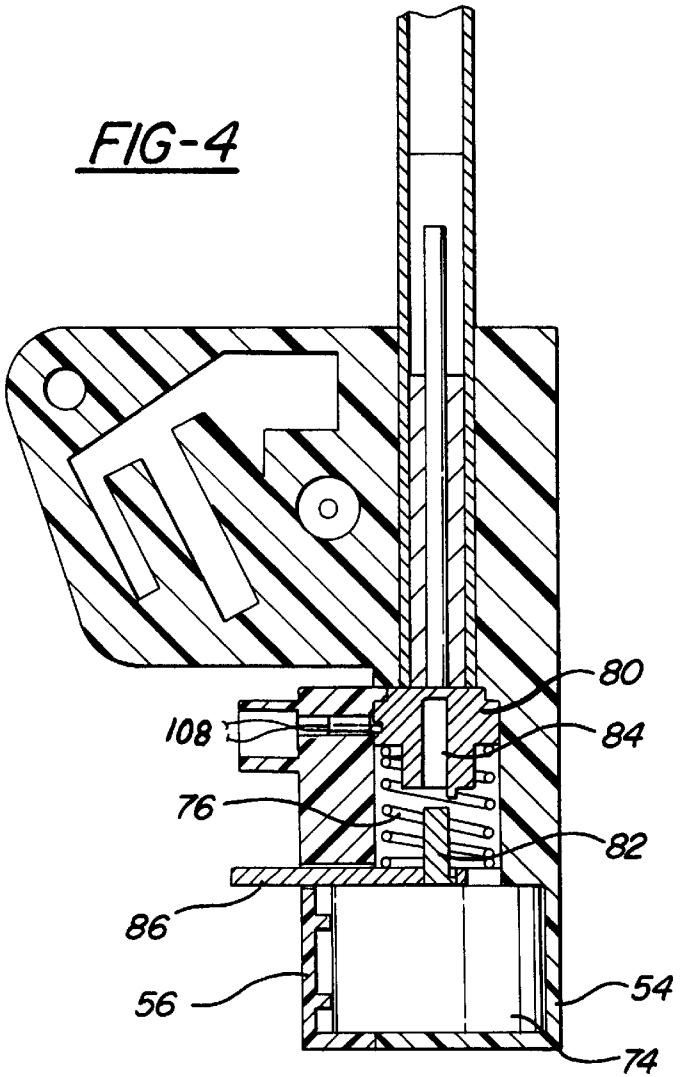
FIG. 4 is a vertical cross sectional view of the transmission selector mechanism.

Also, as previously discussed, the subject invention can be used with a park lock function for a vehicle ignition 38. The vehicle ignition 38 is moveable between an Off position and an On position. A switch 108, shown in FIG. 4, is preferably used to provide a signal 40 to the vehicle 10 to activate the park lock mechanism at the ignition 38 such that the ignition 38 cannot be moved to the Off position until the detent 62 is in the Park position 24. The switch 108 is preferably located in the cover 56 and is activated by axial movement of the rod 42 returning to the retracted position causing the cap 80 to engage the switch 108. The subject invention offers the advantage of incorporating the park lock feature and the brake interlock function into the gear selector mechanism 22 where both are actuated by a single actuator, i.e., the rod 42. The park lock switch 108 is actuated by movement of the rod 42 and cap 80 and the rod 42 also works in conjunction with the actuator 74 for the brake interlock function. Thus, the rod 42 and actuator 74 serve the dual function of providing a brake interlock feature and a park lock feature.

When the separate cap member 80 is used in the interlock system 70, the cap 80 located between the rod 42 and the actuator 74. The cap 80 is preferably non-rotatable and thus only moves axially. The cap 80 is linearly actuated by the rod 42 when the rod 42 is moved into the depressed position causing the cap 80 to engage the actuator 74 for selectively allowing the detent 62 out of the Park position 24.

The biasing member 76 acts axially upon the cap 80 for urging the rod 42 into the retracted position and the detent 62 into the Park 24 and drive 26 positions. The biasing member 76 resiliently biases a first surface 112 of the cap 80 against the bottom end 60 of the rod 42 for returning the rod 42 to the retracted position. The biasing member 76 extends between the actuator 74 and a second surface 114 of the cap 80, the second surface 114 being opposite from the first surface 112.

The actuator 74 is centrally located under the rod 42 and is rotatable between the engaged position where the bottom end 60 of the rod 42 engages the cap 80 causing the cap 80 to be depressed into engagement with the actuator 74 resulting in the detent 62 moving out of the Park position 24 and into one of the plurality of drive positions 26 and the disengaged position where the cap 80 cannot be depressed into engagement with the actuator 74 and the detent 62 is prevented from moving out of the Park position 24.

Figure 8:
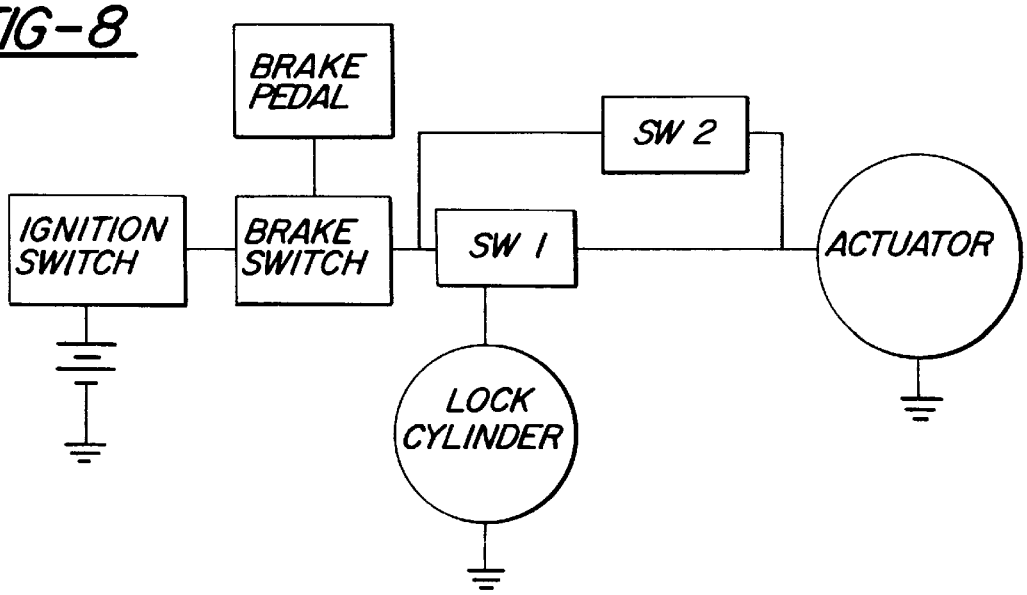
FIG. 8 is a schematic view of the logic circuit for the gear selector mechanism.

FIG. 8 shows a schematic of a brake-transmission-shift interlock (BTSI) with park lock function logic circuit. It should be understood that the schematic shown in FIG. 8 is just an example of a preferred circuit, and that other circuit configurations can be used. The circuit includes an ignition switch and a brake switch. When the ignition 38 is turned to the ON position, the ignition switch is closed and when the brake pedal 18 is depressed, the brake switch is closed. Two (2) switches SW1 and SW2 are in a parallel relationship to each other. The first switch SW1 is connected to a lock cylinder solenoid and the second switch SW2 controls the rotational position of the actuator 74. Normally the system is in the locked position for both the park lock and BTSI functions. When the ignition 38 is ON and BTSI is off, i.e. the brake pedal 18 is not depressed, the system is in the locked position. When the ignition 38 is ON and the brake pedal 18 is depressed, the system is not locked. Thus, when both switches SW1 and SW2 are closed power is supplied to rotate the actuator 74 until it is moved to the engaged position. When both switches SW1 and SW2 are open, no power is supplied to the actuator 74.

The BTSI and park lock functions operate as follows. To shift from park, the ignition 38 is turned ON, the brake pedal 18 is depressed, the actuator 74 rotates to the engaged position, the button 32 is depressed which moves the rod 42 to the depressed position causing the shaft 82 to enter the pocket 84, the gate 44 is cleared and the detent 62 moves out of the park 24 position, the brake pedal 18 is released, the button 32 is released, and the actuator partially rotates back to a position between the engaged and disengaged position due to the internal spring mechanism. In this position the shaft 82 is still partially engaged in the pocket 84, which allows movement of the detent 62 for all gear positions 26 other than moving out of the Park position 24. When the rod 42 and detent 62 are returned to the Park position 24, the shaft 82 is disengaged from the pocket 84 and the cap 80 is returned to its initial position and the actuator is rotated to the disengaged position by the internal spring mechanism. As the cap 80 moves vertically upwardly towards its initial position, the cap 80 actuates switch 108 signaling that the detent 62 is in the Park position 24 and that the key can be removed from the ignition 38.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A transmission selector mechanism comprising:

a gear selector mechanism (22) moveable between a park position (24) and a plurality of drive positions (26), said mechanism (22) including an axially movable rod (42) having a bottom end (60) and a detent (62) extending laterally from said rod (42) for disposition in any one of said park (24) and drive (26) positions; and an interlock system (70) for initially restraining said detent (62) in said park position (24) and characterized by an actuator (74) disposed axially under said rod (42) for rotating about a vertical axis (78) to selectively allow said detent (62) out of said park position (24).

2. A mechanism as set forth in claim 1 wherein said actuator (74) is centrally located under said rod (42) and is rotatable between an engaged position where said bottom end (60) of said rod (42) can be depressed into engagement with said actuator (74) causing said detent (62) to move out of said park position (24) and into one of said plurality of drive positions (26) and a disengaged position where said rod (42) cannot be depressed into engagement with said actuator (74) and said detent (62) is prevented from moving out of said park position (24).

3. A mechanism as set forth in claim 1 including a biasing member (76) acting axially upon said rod (42) for urging said detent (62) into said park (24) and drive (26) positions.

4. A mechanism as set forth in claim 3 wherein said actuator (74) is centrally located under said rod (42) and defines said vertical axis (78) with said biasing member (76) being concentric with said axis (78).

5. A mechanism as set forth in claim 3 wherein said actuator (74) includes an abutment (106) moveable between an abutting position engaging said bottom end (60) of said rod (42) to prevent movement of said detent (62) out of said park position (24) and a release position for allowing said rod (42) to move said detent (62) out of said park position (24).

6. A mechanism as set forth in claim 5 wherein said actuator (74) rotates said abutment (106) into and out of said abutting position.

7. A transmission selector mechanism comprising:

a gear selector mechanism (22) moveable between a park position (24) and a plurality of drive positions (26), said mechanism (22) including an axially movable rod (42) having a bottom end (60) and a detent (62) extending laterally from said rod (42) for disposition in any one of said park (24) and drive (26) positions; and an interlock system (70) for initially restraining said detent (62) in said park position (24) and including an actuator (74) disposed axially under said rod (42) for selectively allowing said detent (62) out of said park position (24) and a biasing member (76) acting axially upon said rod (42) for urging said detent (62) into said park (24) and drive (26) positions, said biasing member (76) comprising a coil spring with a cap (80) supported by said spring, said cap (80) for reacting with said bottom end (60) of said rod (42) wherein said actuator (74) includes an abutment (106) moveable between an abutting position engaging said bottom end (60) of said rod (42) to prevent movement of said detent (62) out of said park position (24) and a release position for allowing said rod (42) to move said detent (62) out of said park position (24), said actuator (74) rotating said abutment (106) into and out of said abutting position.

8. A mechanism as set forth in claim 7 wherein said abutment (106) comprises a shaft (82) having an irregular cross section and said cap (80) includes a female pocket (84) complimentary in cross sectional shape to said shaft (82) for allowing said shaft (82) to move into said pocket (84) when in said release position.

9. A mechanism as set forth in claim 8 including a manual release (86) extending radially from said actuator (74) for rotating said abutment (106) between said abutting and release positions.

10. A vehicle comprising:

a transmission assembly (12);

a braking system (14);

a gear selector mechanism (22) moveable between a park position (24) and a plurality of drive positions (26) for remotely controlling a transmission (20), said mechanism (22) including an axially movable rod (42) having a bottom end face (60) and a detent (62) extending laterally from said rod (42) for disposition in any one of said park (24) and drive (26) positions;

a brake pedal (18) moveable between a rest position and an applied position for remotely controlling the braking system (14);

an interlock system (70) for initially restraining said detent (62) in said park position (24) until said brake pedal (18) is moved to said applied position and characterized by an actuator (74) rotatable between an engaged position and a disengaged position wherein said actuator (74) is rotated to said engaged position when said brake pedal (18) is moved to said applied position such that said bottom end face (60) of said rod (42) can be axially depressed into engagement with said actuator (74) causing said detent (62) to move out of said park position (24) and into one of said plurality of drive positions (26).

11. An assembly as set forth in claim 10 wherein said actuator (74) is disposed axially under said rod (42).

12. An assembly as set forth in claim 11 including a biasing member (76) acting axially upon said rod (42) for urging said detent (62) into said park (24) and drive (26) positions when said actuator (74) is rotated to said disengaged position.

13. An assembly as set forth in claim 10 including a vehicle ignition (38), moveable between an off position and an on position, and a switch (108) for providing a signal (40)

to the vehicle (10) to activate a park lock mechanism at said ignition (38) wherein said ignition (38) cannot be moved to said off position until said detent (62) is in said park position, said switch (108) being activated by axial movement of said rod (42).

14. A vehicle comprising:

a transmission assembly (12);

a braking system (14);

a gear selector mechanism (22) moveable between a park position (24) and a plurality of drive positions (26) for remotely controlling a transmission (20), said mechanism (22) including an axially movable rod (42) having a bottom end (60) and a detent (62) extending laterally from said rod (42) for disposition in any one of said park (24) and drive (26) positions;

a brake pedal (18) moveable between a rest position and an applied position for remotely controlling the braking system (14);

an interlock system (70) for initially restraining said detent (62) in said park position (24) until said brake pedal (18) is moved to said applied position and including an actuator (74) disposed axially under said rod (42) and rotatable between an engaged position and a disengaged position and a biasing member (76) acting axially upon said rod (42) for urging said detent (62) into said park (24) and drive (26) positions when said actuator (74) is rotated to said disengaged position, said actuator (74) including an output shaft (82) formed in a predetermined shape and said rod (42) including an aperture (84) having a corresponding predetermined shape where said output shaft (82) is received in said aperture (84) when said actuator (74) is rotated to said engaged position and said rod (42) is axially depressed wherein said actuator (74) is rotated to said engaged position when said brake pedal (18) is moved to said applied position such that said bottom end (60) of said rod (42) can be axially depressed into engagement with said actuator (74) causing said detent (62) to move out of said park position (24) and into one of said plurality of drive positions (26).

15. An assembly as set forth in claim 14 including a positioning lever (86) fixed for rotation with said actuator (74) and moveable between a first stop (88) and a second stop (90), said first stop (88) corresponding to said disengaged position and said second stop (90) corresponding to said engaged position.

16. An assembly as set forth in claim 15 including a housing for supporting said actuator (74) and said rod (42), said housing defining an opening (92) for receiving said lever (86), said opening (92) having first (94) and second (96) side walls wherein said first stop (88) occurs when said positioning lever (86) engages said first side wall (94) and said second stop (90) occurs when said positioning lever (86) engages said second side wall (96).

17. An assembly as set forth in claim 15 wherein said positioning lever (86) is fixed to said output shaft (82).

18. An assembly as set forth in claim 17 wherein one end (98) of said positioning lever (86) partially extends through said opening (92) such that said lever (86) can be manually shifted between said first (88) and second (90) stops.

19. An assembly as set forth in claim 18 wherein said housing is comprised of a main support member (54) and a cover (56) for attachment to said main support member (54), said main support member (54) having a first pocket (100) for partially receiving said actuator (74) and a second pocket (102) for receiving said bottom end (60) of said rod (42), and said cover (56) having a cover pocket (104) for partially receiving said actuator (74) and including said opening (92) for receiving said positioning lever (86).

20. A transmission selector mechanism comprising:

a gear selector mechanism (22) moveable between a park position (24) and a plurality of drive positions (26), said mechanism (22) including a rod (42) axially moveable between a depressed position and a retracted position, said rod (42) having a bottom end (60) and a detent (62) extending laterally from said rod (42) for disposition in any one of said park (24) and drive (26) positions; and an interlock system (70) for initially restraining said detent (62) in said park position (24) and characterized by an actuator (74) disposed axially under said rod (42) and a cap (80) located between said rod (42) and said actuator (74), said cap (80) being linearly actuated by said bottom end (60) of said rod (42) when said rod (42) is moved into said depressed position causing said cap (80) to engage said actuator (74) for selectively allowing said detent (62) out of said park position (24).

21. A mechanism as set forth in claim 20 including a biasing member (76) acting axially upon said cap (80) for urging said rod (42) into said retracted position and said detent (62) into said park (24) and drive (26) positions.

22. An assembly as set forth in claim 21 wherein said biasing member (76) resiliently biases a first surface (112) of said cap (80) against said bottom end (60) of said rod (42) for returning said rod (42) to said retracted position.

23. An assembly as set forth in claim 22 wherein said biasing member (76) extends between said actuator (74) and a second surface (114) of said cap (80), said second surface (114) being opposite from said first surface (112).

24. A mechanism as set forth in claim 20 wherein said actuator (74) is centrally located under said rod (42) and is rotatable between an engaged position where said bottom end (60) of said rod (42) engages said cap (80) causing said cap (80) to be depressed into engagement with said actuator (74) resulting in said detent (62) moving out of said park position (24) and into one of said plurality of drive positions (26) and a disengaged position where said cap (80) cannot be depressed into engagement with said actuator (74) and said detent (62) is prevented from moving out of said park position (24).

25. An assembly as set forth in claim 24 wherein said actuator (74) includes an output shaft (82) having an irregular cross section and said cap (80) includes a female pocket (84) complimentary in cross sectional shape to said shaft (82) for allowing said shaft (82) to move into said pocket (84) when said actuator (74) is rotated to said engaged position and said rod (42) is moved into said depressed position.

26. An assembly as set forth in claim 24 including a positioning lever (86) fixed for rotation with said actuator (74) and moveable between a first stop (88) and a second stop (90), said first stop (88) corresponding to said disengaged position and said second stop (90) corresponding to said engaged position.

27. An assembly as set forth in claim 26 including a housing for supporting said actuator (74) wherein said positioning lever (86) partially extends through an opening (92) in said housing such that said lever (86) can be manually shifted between said first (88) and second (90) stops.

28. An assembly as set forth in claim 20 wherein said cap (80) is engagable with said bottom end (60) of said rod (42).

* * * * *